US010696525B2

(12) United States Patent
Ryman et al.

(10) Patent No.: US 10,696,525 B2
(45) Date of Patent: Jun. 30, 2020

(54) CONTAINER CRANE CONTROL SYSTEM COMPRISING MULTIPLE CAMERAS

(71) Applicant: ABB Schweiz AG, Baden (CH)

(72) Inventors: André Ryman, Bromma (SE); Peter Almhager, Köping (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/348,802

(22) PCT Filed: Oct. 30, 2017

(86) PCT No.: PCT/EP2017/077730
§ 371 (c)(1),
(2) Date: May 9, 2019

(87) PCT Pub. No.: WO2018/086929
PCT Pub. Date: May 17, 2018

(65) Prior Publication Data

US 2019/0345009 A1 Nov. 14, 2019

(30) Foreign Application Priority Data

Nov. 11, 2016 (EP) ..... 16198339

(51) Int. Cl.
*B66C 13/46* (2006.01)
*B66C 13/40* (2006.01)
(Continued)

(52) U.S. Cl.
CPC ..... *B66C 13/46* (2013.01); *B66C 13/40* (2013.01); *B66C 19/002* (2013.01)

(58) Field of Classification Search
CPC ..... B66C 13/46; B66C 13/40; B66C 19/002; H04N 5/23299; H04N 5/23206; H04N 5/247
See application file for complete search history.

(56) References Cited

U.S. PATENT DOCUMENTS

2004/0126015 A1* 7/2004 Hadell ..... B66C 13/46 382/181
2013/0013144 A1* 1/2013 Tanizumi ..... B66C 23/905 701/34.4

(Continued)

FOREIGN PATENT DOCUMENTS

CN 201161875 Y 12/2008
CN 102530727 A 7/2012

(Continued)

OTHER PUBLICATIONS

Korean Office Action and Translation Application No. 10 2019 7014933 dated Sep. 17, 2019 9 Pages.

(Continued)

*Primary Examiner* — Shahbaz Nazrul
(74) *Attorney, Agent, or Firm* — Whitmyer IP Group LLC

(57) ABSTRACT

A container crane control system includes: a first camera configured to be mounted to a container crane such that the first camera is rotatable only along a substantially vertical axis, implementing a tilt function of the first camera, the first camera being configured to provide a first video signal; a control device configured to tilt the first camera based on a current height of a load of the crane, to thereby track the load; and an operator terminal, being configured to receive the first video signal, for presentation to an operator and being configured to receive user input for controlling the crane, resulting in a crane control signal for provision to the control device. The control device may further be configured to receive the crane control signal from the operator terminal and to provide a corresponding control signal to control crane operation.

19 Claims, 3 Drawing Sheets

(51) Int. Cl.

| | |
|---|---|
| ***B66C 19/00*** | (2006.01) |
| ***H04N 5/232*** | (2006.01) |
| ***H04N 5/247*** | (2006.01) |

(56) References Cited

U.S. PATENT DOCUMENTS

| | | | | |
|---|---|---|---|---|
| 2015/0296105 | A1 | 10/2015 | De Geeter et al. | |
| 2018/0282132 | A1* | 10/2018 | Laitasalmi | B66C 13/18 |
| 2018/0370774 | A1* | 12/2018 | Almhager | B66C 13/085 |
| 2019/0202529 | A1* | 7/2019 | Ritz | B63B 21/04 |
| 2019/0375615 | A1* | 12/2019 | Markwell | B66C 1/34 |
| 2020/0017318 | A1* | 1/2020 | Mannari | G06K 9/00201 |
| 2020/0024109 | A1* | 1/2020 | Rytkonen | B66C 13/46 |

FOREIGN PATENT DOCUMENTS

| | | | |
|---|---|---|---|
| CN | 103332597 | A | 10/2013 |
| CN | 103395694 | A | 11/2013 |
| CN | 104003307 | A | 8/2014 |
| CN | 204675650 | U | 9/2015 |
| CN | 204917698 | U | 12/2015 |
| CN | 105217472 | A | 1/2016 |
| CN | 105293283 | A | 2/2016 |
| CN | 205087819 | U | 3/2016 |
| CN | 205087820 | U | 3/2016 |
| JP | 05246683 | | 9/1993 |
| JP | H05246683 | A | 9/1993 |
| JP | H0853290 | A | 2/1996 |
| JP | H09240987 | A | 9/1997 |
| JP | 3402771 | B2 | 5/2003 |
| JP | 2004137035 | A | 5/2004 |
| JP | WO2015145725 | A1 | 4/2017 |
| KR | 20090053766 | A | 5/2009 |
| KR | 1020100037257 | A | 4/2010 |
| WO | 2010009570 | A1 | 1/2010 |

OTHER PUBLICATIONS

European Search Report Application No. EP 16 19 8339 Completed:May 16, 2017;dated May 26, 2017 12 pages.

International Preliminary Report on Patentability Application No. PCT/EP2017/077730 dated Mar. 6, 2019 23 pages.

International Search Report and Written Opinion of the International Searching Authority Application No. PCT/EP2017/077730 Completed: Jan. 30, 2018; dated Feb. 12, 2018 18 pages.

Written Opinion of the International Searching Authority Application No. PCT/EP2017/077730 dated Oct. 19, 2018 7 pages.

Korean Office Action Translation Application No. 10-2019-7014933 Completed: Jan. 13, 2010 4 pages.

* cited by examiner

CONTAINER CRANE CONTROL SYSTEM COMPRISING MULTIPLE CAMERAS

TECHNICAL FIELD

The invention relates to a container control system, method, computer program and computer program product for controlling a container crane.

BACKGROUND

Container cranes are used to handle freight containers, to transfer containers between transport modes at container terminals, freight harbors and the like. Standard shipping containers are used to transport a great and growing volume of freight around the world. Transshipment is a critical function in freight handling. Trans-shipment may occur at each point of transfer and there is usually a tremendous number of containers that must be unloaded, transferred to a temporary stack, and later loaded on to another ship, or back onto the same ship or loaded instead onto another form of transport.

Traditionally, the container cranes have been controlled in an operator cabin mounted on the container crane. Recently however, container cranes have become remote controlled. This allows an operator so sit in an office and control the crane. This has eliminated many situations in which port workers have been exposed to danger and injury. Loading and unloading the ship is seen as a critical stage or a bottleneck in terms of freight handling as the ships are idle in port during the time that loading and/or unloading takes place. To reduce this idle time, the container cranes are normally run continuously on long shifts until the loading or unloading of each ship is completed. By allowing remote control, changeover time for operator changes (due to new shift, breaks, etc.) is greatly reduced.

CN201161875 is an example of a system in the prior art, disclosing a crane bridge lower truck laser positioning and lifting tool control device. The system uses a PTZ (pan, tilt, and zoom) camera.

In order to see how the container and the crane operate, a video feed is provided from a camera by the crane to the office where the operator is located. However, the camera is placed under a large amount of mechanical and environmental stress due to the movement of the crane and the environment of the crane.

SUMMARY

It is an object to provide a crane control system which is more robust than those provided in the prior art.

According to a first aspect, it is presented a container crane control system for controlling a container crane. The container crane control system comprises: a first camera configured to be mounted to a container crane such that the first camera is rotatable only along a substantially vertical axis, implementing a tilt function of the first camera, the first camera being configured to provide a first video signal; a control device configured to tilt the first camera based on a current height of a load of the crane, to thereby track the load; and an operator terminal, being configured to receive the first video signal, for presentation to an operator and being configured to receive user input for controlling the crane, resulting in a crane control signal for provision to the control device; wherein the control device is further configured to receive the crane control signal from the operator terminal and to provide a corresponding control signal to control crane operation.

It is also presented a container crane control system for controlling a container crane. The container crane control system comprises: a first camera configured to be mounted to a container crane such that the first camera is rotatable only along a substantially vertical axis, implementing a tilt function of the first camera, the first camera being configured to provide a first video signal; a control device configured to tilt the first camera based on an expected future position of a load engagement action, the expected future position being derived from a work order; and an operator terminal, being configured to receive the first video signal, for presentation to an operator and being configured to receive user input for controlling the crane, resulting in a crane control signal for provision to the control device; wherein the control device is further configured to receive the crane control signal from the operator terminal and to provide a corresponding control signal to control crane operation. Load engagement action is here to be interpreted as the start or end of an engagement between the container crane and the container.

The container crane control system may further comprise: a second camera configured to be mounted to the container crane such that the second camera is rotatable only along a substantially vertical axis, implementing a tilt function of the second camera, the second camera being configured to provide a second video signal. In this case, the control device is configured to tilt also the second camera on the same basis on which the first camera is tilted and the operator terminal is configured to receive also the second video signal, for presentation to an operator. In one embodiment, the control device is configured to tilt also the second camera based on a current height of a load of the crane, to thereby track the load. In one embodiment, the control device is configured to tilt also the second camera based on an expected future position of a load engagement action, the expected future position being derived from a work order.

The control device may be further configured to select, based on the current height of a load, the first camera as a main image source or the second camera as a main image source for the operator terminal.

The operator terminal may be configured to display the video signal only from the main image source.

Each one of the first camera and the second camera may comprise a zoom function, in which case the control device is further configured to zoom each one of the first camera and the second camera based on the current height of a load or the expected future position.

The control device may be further configured to tilt each one of the first camera and the second camera based on a current size of the load.

The control device may be further configured to tilt each one of the first camera and the second camera based on a current configuration of a spreader of the container crane.

The container crane control system may further comprise: a third camera configured to be mounted to the container crane such that the third camera is rotatable only along a substantially vertical axis, implementing a tilt function of the third camera, the third camera being configured to provide a third video signal. In such a case, the control device is configured to tilt also the third camera based on a current height of a load (21) of the crane, to thereby track the load (21); and the operator terminal, is configured to receive at least one of the first video signal, the second video signal and the third video signal, for presentation to an operator.

According to a second aspect, it is presented a method for controlling a container crane. The method is performed in a container control system and comprises the steps of: receiving a first video signal from a first camera mounted to a container crane such that the first camera is rotatable along a substantially vertical axis, implementing a tilt function of the first camera; tilting the first camera based on a current height of a load of the crane, to thereby track the load; providing the first video signal to an operator terminal for presentation to an operator; and providing a crane control signal based on user input for controlling the crane.

It is also presented a method for controlling a container crane. The method is performed in a container control system and comprises the steps of: receiving a first video signal from a first camera mounted to a container crane such that the first camera is rotatable along a substantially vertical axis, implementing a tilt function of the first camera; tilting the first camera based on an expected future position of a load engagement action, the expected future position being derived from a work order; providing the first video signal to an operator terminal for presentation to an operator; and providing a crane control signal based on user input for controlling the crane.

The method according may further comprise the step of: receiving a second video signal from a second camera mounted to the container crane such that the second camera is rotatable along a substantially vertical axis, implementing a tilt function of the second camera; wherein the step of tilting comprises tilting also the second camera on the same basis on which the first camera is tilted; and wherein the step of providing comprises providing also the second video signal to the operator terminal for presentation to the operator.

The method may further comprise the step of: selecting, based on the current height of a load, the first camera as a main image source or the second camera as a main image source for the operator terminal.

According to a third aspect, it is presented a computer program for controlling a container crane, the computer program comprising computer program code which, when run on a container control system causes the container control system to perform the method according to the second aspect.

According to a fourth aspect, it is presented a computer program product comprising a computer program according to the third aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc.", are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
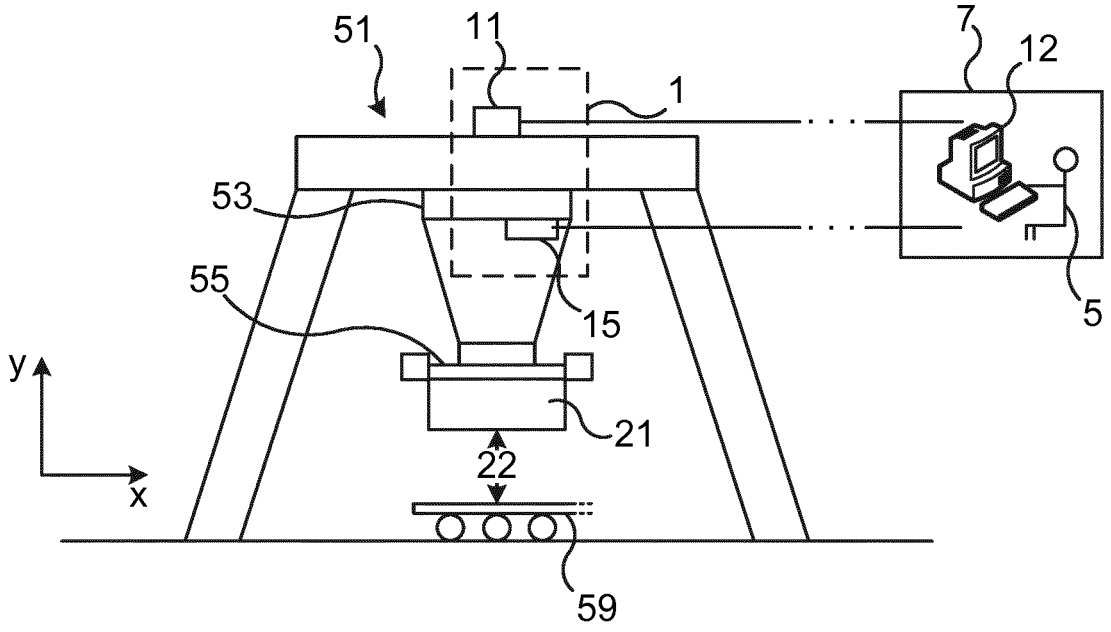
FIG. 1 is a schematic diagram illustrating a container crane environment in which embodiments presented herein can be applied.
Figure 2:
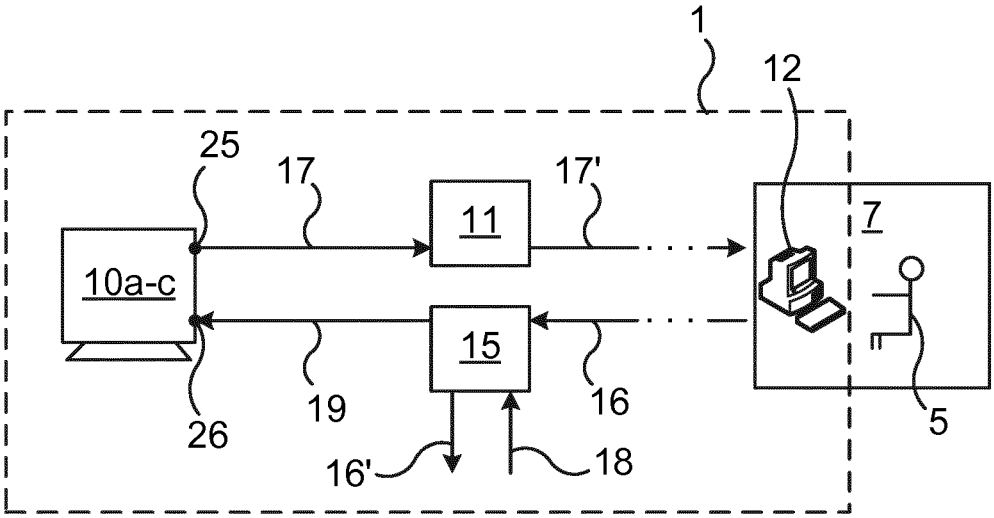
FIG. 2 is a schematic diagram illustrating a container crane control system of FIG. 1 according to one embodiment.

FIG. 1 is a schematic diagram illustrating a container crane environment in which embodiments presented herein can be applied and FIG. 2 is a schematic diagram illustrating a container crane control system of FIG. 1 according to one embodiment. A combined description with references to both FIG. 1 and FIG. 2 will now be presented. The view is along an x-y plane in a coordinate system.

A container crane 51 uses a number of powerful electric motors mounted on a spreader 55 and on a trolley 53 to power moving parts and wind in or let out the wire ropes or cables used to lift up or down the spreader 55. The spreader 55 can hold a load 21 in the form of a container. Electric motors are also used to power the movements of the trolley 53 holding the spreader 55, to lift and transport the containers out of the ship and onto a truck chassis 59 or a stack etc. The container crane 51 can be used for loading containers on a ship and for unloading containers from a ship to land.

The width of shipping containers is standardized at 8 ft. (2.436 m), but the height varies, typically between from 8 ft. (2.436 m) and 9.5 ft. (2.896 m). The most common standard lengths are 20 ft. (6.096 m) and 40 ft. (12.192 m) long. The 40 ft. (12.192 m) container is very common today and even longer containers up to 53 ft. (16.154 m) long are also in use. International standard dimensions are based on a number of ISO recommendations made between 1968 and 1970, and in particular a recommendation R1161 from January 1970, which made recommendations about dimensions of corner fittings for standard containers. It could be said that the distances between corner fittings on standard shipping containers are standardized in accordance with the ISO recommendations. The corner fittings, also known as corner castings, include standard openings so that a container may be picked up by inserting a hook of the spreader 55 into each of the four corner fittings at the top of the container 21. The size and shape of the oval-shaped openings are defined in another standard ISO 1161 from 1984. The same type of corner fittings, e.g., those on the bottom of a container, may be used to lock a container in place in a position (e.g., in a hold or on deck) on board a ship or on a wagon or a chassis.

The spreader 55 is thus used to grip the container 21 using hooks, twistlocks or other fittings to engage with the standard sized opening in the corner fittings on the container, to lift it, lower it and release it. In this description, the term spreader 55 is used to denote a part of a lifting device that is in direct contact with a container 21. Spreaders 55 are normally designed to handle more than one size of container, typically 20-40 ft. (6.096-12.192 m) or 20-40-45 ft. (6.096-12.192-13.716 m) long containers. A spreader 55 may at any time lift and handle one single 40 ft. (12.192 m) or a 45 ft. (13.716 m) container or two 20 ft. (6.096 m) containers. Some spreaders 55 are adjustable in use so that the same spreader 55 can be used to pick up one 20 ft. (6.096 m), or two 20 ft. (6.096 m) containers at a time by adjusting the length of the spreader.

The container crane 51 can thus be used to lift a container 21 up from a ship and land it on a chassis 59, or vice versa. Alternatively, the container crane 51 can be used to transfer the container 21 between the ship and ground or a container stack or any other suitable container movement.

A container crane control system 1 is used to control the operation of the crane 51. In order to allow remote control of the crane 51, e.g., from an office 7, the container crane control system 1 comprises several cameras 10*a-c* (shown in more detail in FIG. 3 and explained below) and a control device 15.

The cameras 10*a-c* can be digital cameras or analogue cameras. In any case, each camera comprises a respective video output 25 for providing a respective video signal 17. Moreover, each camera comprises a respective control signal input 26. The cameras 10*a-c* are used to capture images containing at least part of the load 21 and the spreader 55. The video output 25 can be of any suitable type, and can e.g., comprise a video connector for any one of HD-SDI (High Definition Serial Digital Interface), HDMI (High Definition Multimedia Interface), DVI (Digital Video Interface), DisplayPort, VGA (Video Graphics Array), component video, composite video, etc. The video signal 17 is in the form of a video stream, i.e., a representation of a series of images. The video signal 17 can be in the form of a compressed video signal or uncompressed video signal.

Camera control signals provided on the control signal input 26 controls a tilt (i.e., a rotation along a substantially vertical axis) of the respective camera 10*a-c* and optionally a zoom level of the respective camera 10*a-c*.

The control device 15 is any suitable control device capable of performing logic operations and can comprise any combination of a central processing unit (CPU), a microcontroller unit (MCU), an application specific integrated circuit (ASIC), a field programmable gate array (FPGA), and discrete logic circuitry, optionally combined with persistent memory (e.g., read only memory, ROM).

The control device 15 receives an input signal 18 which is used for controlling the cameras. The input signal 18 comprises information about a current height 22 of the load 21. Optionally, the input signal 18 comprises information about a current size of the load and/or a current configuration of the spreader 55, which is indicative of the size of the load. The control device 15 is connected to the cameras 10*a-c* to send a camera control signal 19 to control tilt and optionally zoom of each camera based on the current height 22 of the load 21 (and optionally load size and/or spreader configuration).

An operator terminal 12 forms part of the container crane control system 1 and is connected to the cameras 10*a-c* and the control device 15, e.g., over an IP (Internet Protocol) link, over a wired (e.g., Ethernet) or wireless (e.g., any of the IEEE 802.11 standards) interface. The operator terminal 12 can e.g., be a stationary or laptop computer or any other suitable device configured to receive and present the video signal and to allow user input. The operator terminal 12 is thus configured to receive the video signal for presentation to an operator 5. Moreover, the operator 5, based on the displayed video signal, can provide input to the operator terminal 12 for controlling the crane. This results in a crane control signal 16 for provision to the control device 15. The control device 15 receives the crane control signal 16 from the operator terminal 12 and provides a corresponding control signal 16' to control crane operation, thereby affecting motors of the crane 51, e.g., to lift or lower the container 21 or to move the trolley 53. Optionally, the control device 15 physically forms part of the operator terminal 12.

In one embodiment, the cameras 10*a-c* are responsive to a zoom signal forming part of the camera control signal 19. The zooming functionality in the cameras 10*a-c* can be implemented using an optical zoom and/or a digital zoom.

The zoom signal can be controlled autonomously by the control device 15. In such a case, the control device 15 sends a zoom signal to the camera 10 to zoom in when the height of the load decreases (i.e., moves further away from the camera 10), and to send a zoom signal to the camera to zoom out when the height of the load increases (i.e., moves towards the camera). Optionally, the autonomously derived zoom can be overridden by the operator 5 using the operator terminal 12.

In order to efficiently encode the video, an encoder 11 is optionally provided. The encoder 11 receives the video signal 17 from the cameras 10*a-c* and encodes the video signal to a compressed digital video stream 17', e.g., H.264. The compressed digital video stream 17' is then provided to the operator terminal 12. By providing the encoder distinct from the cameras, the cameras can be of a simpler implementation.

Figure 3:
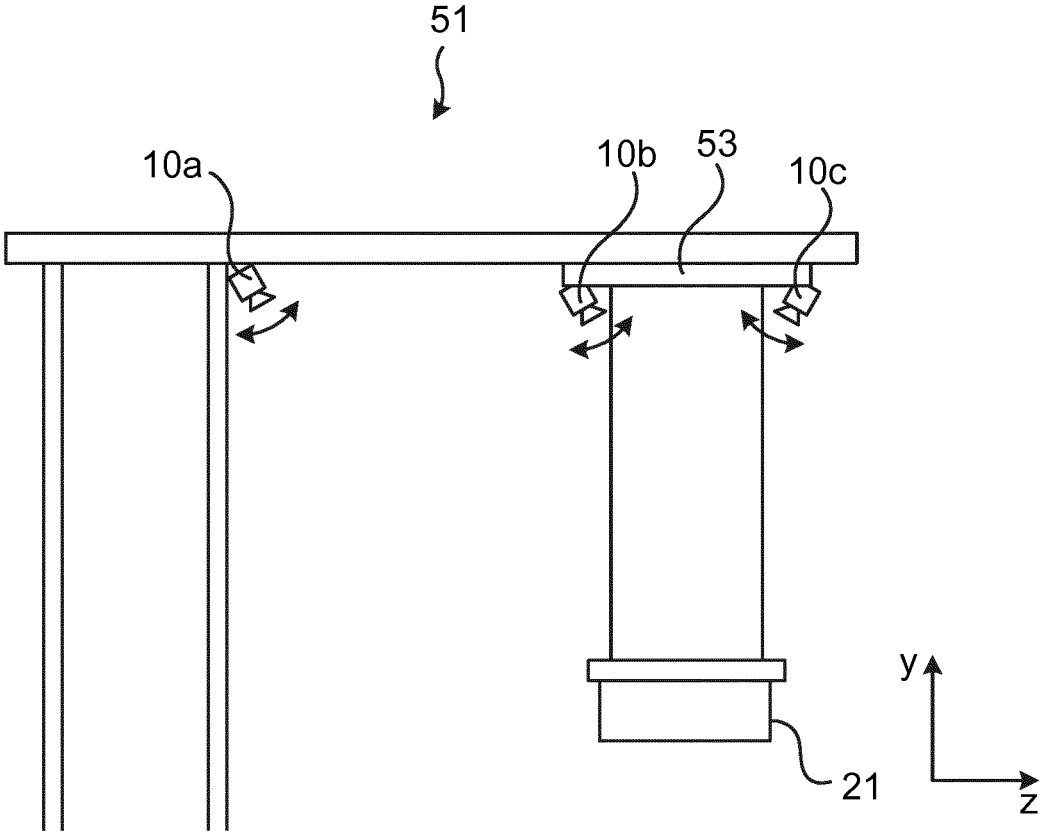
FIG. 3 is a schematic diagram illustrating camera placement in the container crane control system of FIG. 1 according to one embodiment.

FIG. 3 is a schematic diagram illustrating camera placement in the container crane control system of FIG. 1 according to one embodiment. The view is along a z-y plane in the same coordinate system as for FIG. 1. Hence, the view of FIG. 3 is from the side whereas the view in FIG. 1 is from the front (or back).

There is a first camera 10*a* provided on the crane, a second camera 10*b* provided at the rear part of the trolley 53 and a third camera 10*c* provided at the front part of the trolley 53.

All three cameras 10*a-c* can be controlled such that the camera 10*a-c* is rotatable only along a substantially vertical axis, implementing a tilt function of the cameras 10*a-c*. Substantially can here be interpreted as within a margin of error of +/−10 degrees.

Significantly, all cameras 10*a-c* are provided with only vertical rotational movement (tilt) and thus do not have a pan function (i.e., horizontal rotational movement). By only allowing rotation along one axis (the vertical axis), the camera mountings can be made much more robust to withstand mechanical stress during crane movement, trolley movement. Moreover, the cameras are less impacted by environmental factors (wind, rain, snow, etc.) since the mechanical requirements for the rotation are significantly reduced when support for only one rotational axis needs to be provided. Consequently, the implementation of cameras being rotatable only in the vertical direction, i.e., being tiltable only, provides an enormous improvement in reliability compared to the prior art.

It is to be noted that while three cameras are shown in FIG. 3, the container crane control system can be provided with any suitable number of cameras.

Figure 4:
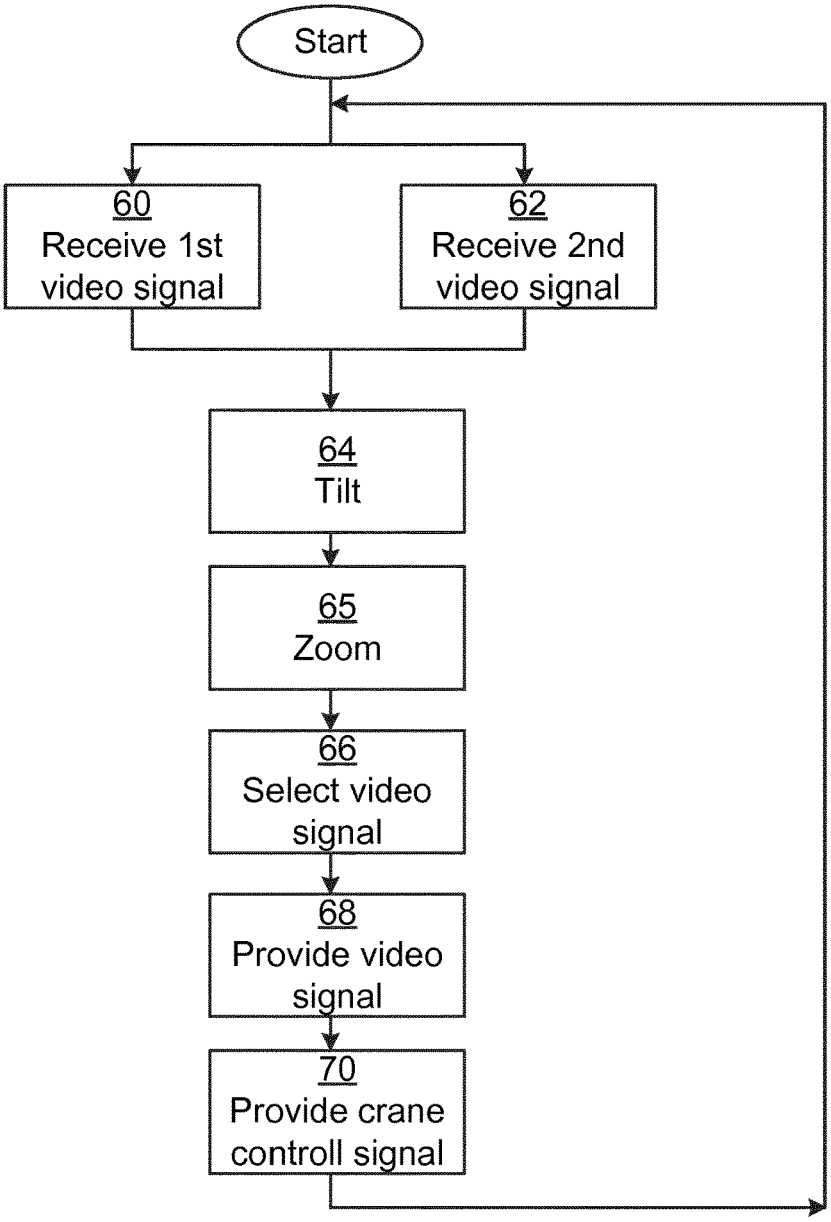
FIG. 4 is a schematic diagram illustrating a method for controlling a container crane control system according to one embodiment.
Figure 5:
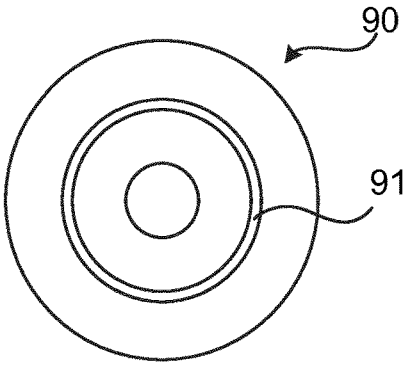
FIG. 5 shows one example of a computer program product comprising computer readable means.

FIG. 4 is a schematic diagram illustrating a method for controlling a container crane according to one embodiment. The method is performed in a container crane control system.

In a receive 1st video signal step 60, a first video signal is received from a first camera mounted to the container crane such that the first camera is rotatable along a substantially vertical axis. This implements a tilt function of the first camera.

In an optional receive 2nd video signal step 62, a second video signal is received from a second camera mounted to the container crane such that the second camera is rotatable along a substantially vertical axis. This implements a tilt function of the second camera.

It is to be noted that more cameras and respective video signals can optionally be received. For instance, a third camera, such as shown in FIG. 3, can be provided, resulting in a 3rd video signal.

In a tilt step 64, each one of the first camera and the second camera (when present) is tilted based on a current height of a load (or spreader) of the crane, to thereby track the load. Optionally, this comprises tilting each one of the first camera and the second camera (when present) based on a current size of the load. Optionally, this comprises tilting each one of the first camera and the second camera (when present) based on a current configuration of a spreader of the container crane. Alternatively, the tilt is based on an expected future position of a load engagement action. The expected future position is derived from a work order. The work order contains information about planned container movements of the crane (either the spreader within the crane and/or the crane itself) and can e.g., be obtained from a terminal operating system. The work order comprises engagement events in the form of engagements and disengagements between the container crane and the container. For instance, if the next movement in the work order is to pick up a container on a ship, the expected future position of the load engagement action is the position of the container to be picked up. Hence the tilt can already be adjusted towards the container to be picked up. Eventually, the spreader will also be within the view of the camera when the spreader approaches the expected future position. When the container crane control system comprises several cameras, one camera can be tilted based on the expected future position of the load engagement action while one or more other cameras are tilted based on a current height of the load to thereby track the load.

In an optional zoom step 65, each one of the first camera and the second camera (when present) are zoomed based on the current height of a load or the expected future position of the engagement action (derived from the work order). When the container crane control system comprises several cameras, one camera can be zoomed based on the expected future position of the load engagement action while one or more other cameras are zoomed based on a current height of the load to thereby track the load.

In an optional select video signal step 66, either the first camera is selected as a main image source or the second camera is selected as a main image source for the operator terminal. The selection is made based on the current height of the load. On the operator terminal, the main image source is presented more prominently. For instance, the operator terminal can be configured to display the video signal only from the main image source.

This step can be explained with reference also to FIG. 3. In one example, when the spreader is high up, the second camera 10*b* or the third camera 10*c* camera is selected as the main image source for the operator camera. In this way, the operator can operate to move the trolley and the spreader to a suitable position for loading or unloading a container. On the other hand, when the spreader is low down, close to engaging or disengaging with a load, the first camera 10*a* is selected as the main image source for the operator camera such that the operator can see the height of the spreader in relation to surrounding land/truck chassis/containers. Other implementations are also possible.

In a provide video signal step 68, at least one of the first video signal and the second video signal (when present) is provided to an operator terminal for presentation to an operator.

In a provide crane control signal step 70, a crane control signal is provided based on user input for controlling the crane.

FIG. 6 shows one example of a computer program product comprising computer readable means. On this computer readable means a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device. While the computer program 91 is here schematically shown as a track on the depicted optical disk, the computer program can be stored in any way which is suitable for the computer program product, such as a removable solid state memory, e.g., a Universal Serial Bus (USB) drive.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A container crane control system for controlling a container crane, the container crane control system comprising:

a first camera configured to be mounted to a container crane such that the first camera is rotatable to only allow vertical rotational movement, implementing a tilt function of the first camera, the first camera being configured to provide a first video signal;

a control device configured to tilt the first camera based on a current height of a load of the crane, to thereby track the load; and an operator terminal, being configured to receive the first video signal, for presentation to an operator and being configured to receive user input for controlling the crane, resulting in a crane control signal for provision to the control device;

wherein the control device is further configured to receive the crane control signal from the operator terminal and to provide a corresponding control signal to control crane operation.

2. A container crane control system for controlling a container crane, the container crane control system comprising:

a first camera configured to be mounted to a container crane such that the first camera is rotatable to only allow vertical movement, implementing a tilt function of the first camera, the first camera being configured to provide a first video signal;

a control device configured to tilt the first camera based on an expected future position of a load engagement action, the expected future position being derived from a work order; and an operator terminal, being configured to receive the first video signal, for presentation to an operator and being configured to receive user input for controlling the crane, resulting in a crane control signaler for provision to the control device;

wherein the control device is further configured to receive the crane control signal from the operator terminal and to provide a corresponding control signal to control crane operation.

3. The container crane control system according to claim 1, further comprising:

a second camera configured to be mounted to the container crane such that the second camera is rotatable to only allow vertical rotational movement, implementing a tilt function of the second camera, the second camera being configured to provide a second video signal;

wherein the control device is configured to tilt also the second camera on the same basis on which the first camera is tilted; and wherein the operator terminal is configured to receive also the second video signal, for presentation to an operator.

4. The container crane control system according to claim 3, wherein the control device is further configured to select, based on the current height of a load, the first camera as a main image source or the second camera as a main image source for the operator terminal.

5. The container crane control system according to claim 4, wherein the operator terminal is configured to display the video signal only from the main image source.

6. The container crane control system according to claim 3, wherein each one of the first camera and the second camera includes a zoom function, and wherein the control device is further configured to zoom each one of the first camera and the second camera based on the current height of a load or the expected future position.

7. The container crane control system according to claim 3, wherein the control device is further configured to tilt each one of the first camera and the second camera based on a current size of the load.

8. The container crane control system according to claim 3, wherein the control device is further configured to tilt each one of the first camera and the second camera based on a current configuration of a spreader of the container crane.

9. The container crane control system according to claim 3, further comprising:

a third camera configured to be mounted to the container crane such that the third camera is rotatable to only allow vertical rotational movement, implementing a tilt function of the third camera, the third camera being configured to provide a third video signal;

wherein the control device is configured to tilt also the third camera based on a current height of a load of the crane, to thereby track the load; and the operator terminal, is configured to receive at least one of the first video signal, the second video signal, and the third video signal, for presentation to an operator.

10. A method for controlling a container crane, the method being performed in a container control system and comprising the steps of:

receiving a first video signal from a first camera mounted to a container crane such that the first camera is rotatable to only allow vertical rotational movement, implementing a tilt function of the first camera;

tilting the first camera based on a current height of a load of the crane, to thereby track the load;

providing the first video signal to an operator terminal for presentation to an operator; and providing a crane control signal based on user input for controlling the crane.

11. A method for controlling a container crane, the method being performed in a container control system and comprising the steps of:

receiving a first video signal from a first camera mounted to a container crane such that the first camera is rotatable to only allow vertical rotational movement, implementing a tilt function of the first camera;

tilting the first camera based on an expected future position of a load engagement action, the expected future position being derived from a work order;

providing the first video signal to an operator terminal for presentation to an operator; and providing a crane control signal based on user input for controlling the crane.

12. The method according to claim 10, further comprising the steps of:

receiving a second video signal from a second camera mounted to the container crane such that the second camera is rotatable to only allow vertical rotational movement, implementing a tilt function of the second camera;

wherein the step of tilting includes tilting also the second camera on the same basis on which the first camera is tilted; and wherein the step of providing includes providing also the second video signal to the operator terminals for presentation to the operator.

13. The method according to claim 12, further comprising the steps of:

selecting, based on the current height of a load, the first camera as a main image source or the second camera as a main image source for the operator terminal.

14. A computer program product comprising a non-transitory computer readable means on which a computer program is stored, the computer program having computer program code which, when run on a container control system, causes the container control system to perform a method of controlling a container crane, the method including the steps of:

receiving a first video signal from a first camera mounted to a container crane such that the first camera is rotatable to only allow vertical rotational movement, implementing a tilt function of the first camera;

tilting the first camera based on a current height of a load of the crane, to thereby track the load;

providing the first video signal to an operator terminal for presentation to an operator;

and providing a crane control signal based on user input for controlling the crane.

15. The container crane control system according to claim 2, further comprising:

a second camera configured to be mounted to the container crane such that the second camera is rotatable to only allow vertical rotational movement, implementing a tilt function of the second camera, the second camera being configured to provide a second video signal;

wherein the control device is configured to tilt also the second camera on the same basis on which the first camera is tilted; and wherein the operator terminal is configured to receive also the second video signal, for presentation to an operator.

16. The container crane control system according to claim 4, wherein each one of the first camera and the second camera includes a zoom function, and wherein the control device is further configured to zoom each one of the first camera and the second camera based on the current height of a load or the expected future position.

17. The container crane control system according to claim 4, wherein the control device is further configured to tilt each one of the first camera and the second camera based on a current size of the load.

18. The container crane control system according to claim 4, further comprising:

a third camera configured to be mounted to the container crane such that the third camera is rotatable to only allow vertical rotational movement, implementing a tilt function of the third camera, the third camera being configured to provide a third video signal;

wherein the control device is configured to tilt also the third camera based on a current height of a load of the crane, to thereby track the load; and the operator terminal, is configured to receive at least one of the first video signal, the second video signal, and the third video signal, for presentation to an operator.

19. The method according to claim 11, further comprising the steps of:

receiving a second video signal from a second camera mounted to the container crane such that the second camera is rotatable to only allow vertical rotational movement, implementing a tilt function of the second camera;

wherein the step of tilting includes tilting also the second camera on the same basis on which the first camera is tilted; and wherein the step of providing includes providing also the second video signal to the operator terminal for presentation to the operator.

* * * * *